United States Patent [19]

Steverson

[11] Patent Number: 4,718,122

[45] Date of Patent: Jan. 12, 1988

[54] CONVERTIBLE GARMENT

[76] Inventor: Buddy Steverson, P.O. Box 269; Main St., New Hebron, Miss. 39140

[21] Appl. No.: 39,915

[22] Filed: Apr. 20, 1987

[51] Int. Cl.[4] ..... A41D 15/00

[52] U.S. Cl. ..... 2/70; 2/72; 2/79; 2/86; 2/DIG. 6

[58] Field of Search ..... 2/70, 72, 74, 79, DIG. 6, 2/DIG. 7, 213, 227, 269, 232, 114, 69.5, 86

[56] References Cited

U.S. PATENT DOCUMENTS

| | | | |
|---|---|---|---|
| 1,462,515 | 7/1923 | McElroy | 2/72 |
| 2,080,814 | 5/1937 | Foltz | 2/72 |
| 2,213,900 | 9/1940 | Buchanan | 2/72 |
| 2,598,462 | 5/1952 | Strauss | 2/69.5 |
| 2,622,247 | 12/1952 | Strauch | 2/70 |
| 3,555,567 | 1/1971 | Owen | 2/69.5 |
| 4,158,892 | 6/1979 | Gonzales | 2/84 X |
| 4,601,066 | 7/1986 | Campbell | 2/70 |

FOREIGN PATENT DOCUMENTS

| | | | |
|---|---|---|---|
| 226132 | 12/1924 | United Kingdom | 2/86 |

*Primary Examiner*—H. Hampton Hunter
*Attorney, Agent, or Firm*—Larson and Taylor

[57] ABSTRACT

A convertible garment which is convertible to a car coat length, to a raincoat length, to a ground engaging length, and to a coverall is disclosed. The garment includes a left front panel, left back panel, right front panel, and right back panel which are appropriately attached together and to which sleeves are attached. A mechanism is provided for releasably holding the lower portions of the panels against the respective middle portion of the panels to form a car coat length garment. A first extension mechanism is also provided for extending the lower portions of the panels downwardly to a position to form a raincoat length garment and for releasably holding the extended lower portions of the panels against the respective portions of the panels. A second extension mechanism is also provided for extending a remaining lower portion of the panels downwardly to a position to form a ground engaging length garment. Besides attaching the front of the garment together using buttons or the like, a back vent of the garment is also preferably provided with a mechanism for attaching the vent together when desired. The coverall is formed by appropriately forming the lower portions of the left panels and the right panels into legs, with the bottom of the legs gathered around the ankles of the user.

7 Claims, 6 Drawing Figures

CONVERTIBLE GARMENT

FIELD OF THE INVENTION

The present invention relates generally to a convertible garment, and more particularly to a garment which is convertible from a car coat length, to a raincoat length, to a saddle coat length, as well to a coverall.

BACKGROUND OF THE INVENTION

Various convertible garments have been disclosed in the prior art. For example, in U.S. Pat. No. 4,485,493 (Leinoff), a clothing article convertible from a coat style to a culotte style is disclosed. This conversion is accomplished by inside leg flaps. Another convertible garment is disclosed in U.S. Pat. No. 3,389,407 (Morrison). In this patent, a short raincoat includes fold out leg portions which are carried in a hollow tubular hem or along the backside of the coat. Each leg is gathered around the leg of the user by use of snap fasteners along the in-seams.

A sleeping bag which is convertible to, a jump suit jacket and vest is disclosed in U.S. Pat. No. 4,158,892 (Gonzales). A similar ambulatory sleeping bag is disclosed in U.S. Pat. No. 4,507,805 (Calutoiu). Convertible infant garments which are convertible from a bunting to a jump suit are also disclosed in U.S. Pat. Nos. 2,598,462 ( Strauss), 2,915,758 (Kaufman), and 3,555,567 (Owen).

SUMMARY OF THE INVENTION

In accordance with the present invention, a convertible garment for a user includes a left front panel and a left back panel which are joined along a common longitudinal left side seam and a top seam. A left sleeve is attached to the left front panel and left back panel between the longitudinal left side seam and top left seam. A right front panel and right back panel are similarly configured. Each of the panels includes an upper portion, a middle portion, and a lower portion. A back seam is also provided which connects the upper portions of the left back panel and right back panel and extends downwardly to the buttocks regions. A holding means is provided for releasably holding the lower portions of the panels against the respective middle portion to form a car coat length garment. A first front attaching means attaches adjacent upper and middle portions of the right front panel and left front panel to form the car coat garment. A first extension means is then provided for extending the lower portions of the panels downwardly to a position to form a raincoat length garment and for releasably holding the extended lower portions against a respective portion of the respective panel. A second front attaching means is then provided for attaching adjacent lower portions of the left front panel and right front panel together to close the raincoat garment. Finally, a second extension means is provided for extending a remaining lower portion of the panels downwardly to a position to form a ground engaging length garment. Then, a third front attaching means attaches adjacent remaining lower portions of the left front panel and right front panel together to close the ground engaging coat garment.

In a preferred embodiment, a back attaching means is also provided for releasably attaching the lower portions of the left back panel and right back panel together when the ground engaging garment is formed. In this manner, movement of the feet of the user beneath the garment remains hidden at all times.

The convertible garment of the present invention preferably also includes a pants forming means for forming the lower portions of the left panels into a left pants leg and for forming the lower portions of the right panels into a right pants leg. In this manner, a coverall garment is provided. A gathering means is also provided for gathering the bottom of each pants leg tight around the respective ankle of the user so that the bottom does not drag on the ground and stays in place.

In the preferred embodiment, the second front attaching means and third front attaching means include a plurality of outside elements and outside mating holders. One of these plurality of elements or holders is located along the left front panel while the other of the plurality of elements or holders is located along the right front panel. In addition, the back attaching means includes the one of the plurality of elements or holders located along the right back panel and the other of the plurality of elements or holders located along the left back panel. Thus, the pants forming means includes the plurality of elements and holders on the right back panel, left front panel, and the left back panel as well as the one of the plurality of elements and holders located along an inside edge of the right front panel. Conveniently, the one of the plurality of elements and holders is a plurality of buttons and the other of the plurality of elements and holders is a plurality of button holes. In addition, the holding means also preferably includes a plurality of elements and mating holders such as buttons and button holes.

It is an object of the present invention to provide a convertible garment which is convertible from a car coat length, to a raincoat length coat, to a ground engaging length, and to a coverall.

It is also an object of the present invention to provide a convertible garment which is waterproof.

Is is a further object of the present invention to provide a convertible garment which is easily converted to the different garments quickly and easily.

Still another object of the present invention is to provide a garment useable for hunting having a ground engaging length which is used to hide movements of the feet of the user.

Other features and objects of the present invention are stated in or apparent from a detailed description of a presently preferred embodiment of the invention found hereinbelow.

DETAILED DESCRIPTION OF THE PREFERRED EMBODIMENT

Figure 1:
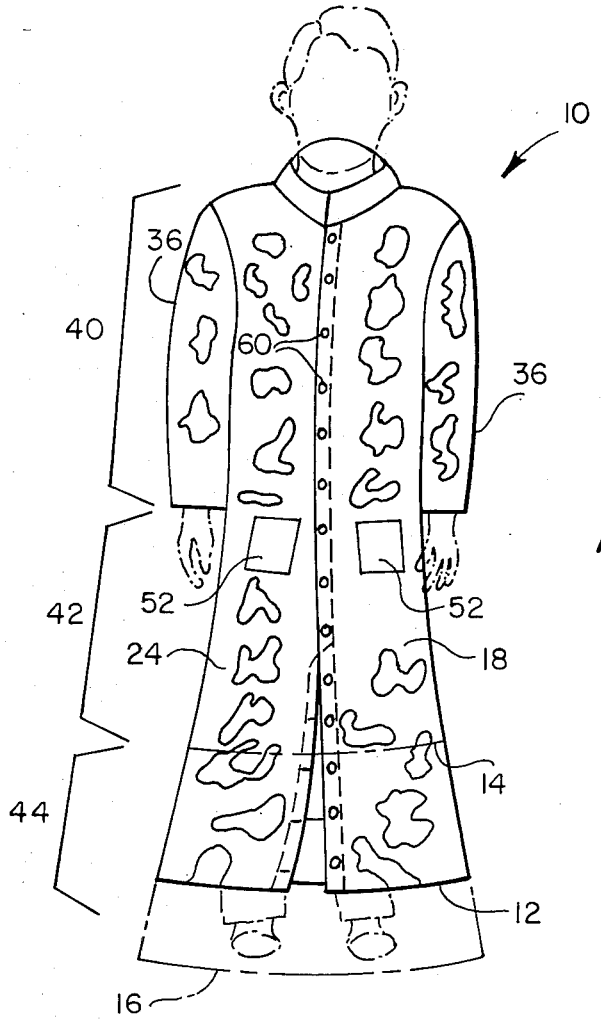
FIG. 1 is a front elevation view of a convertible garment according to the present invention in coat form.
Figure 2:
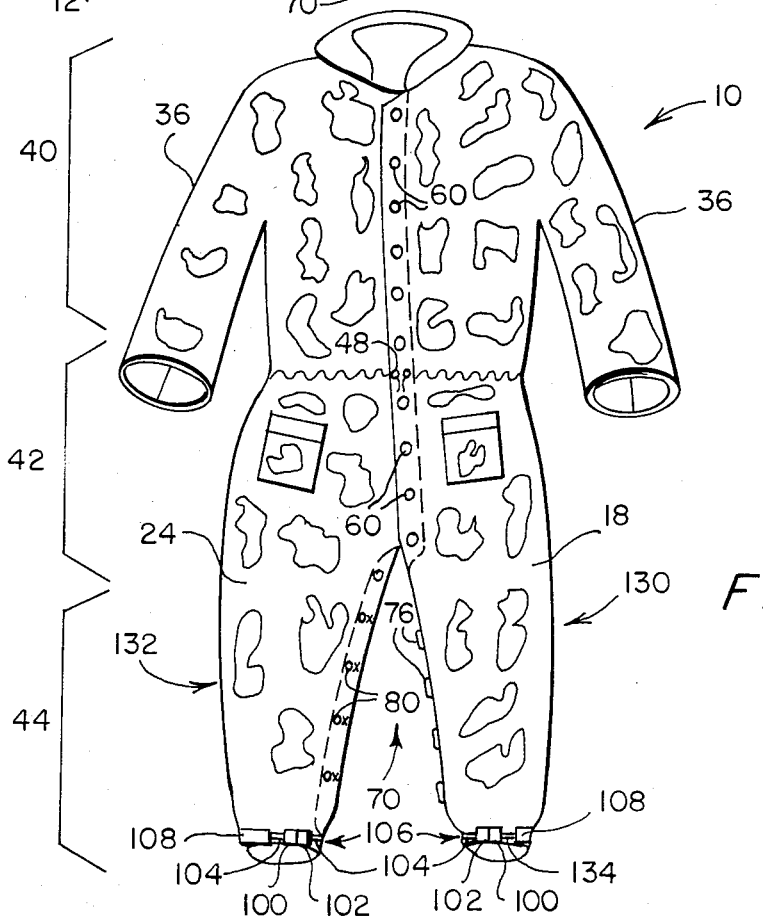
FIG. 2 is a front elevation view of the convertible garment depicted in FIG. 1 in the form of a coverall.

With reference now to the drawings in which like numerals represent like elements throughout the several views, a convertible garment 10 according to the present invention is depicted in FIGS. 1 to 5. In FIG. 1, convertible garment 10 is depicted as having a raincoat length with a bottom 12. Also depicted in FIG. 1 by way of a phantom line is the length of convertible garment 10 when it is converted to a car coat length so that convertible garment 10 has a bottom 14 (in phantom lines). Finally, convertible garment 10 is also depicted in FIG. 1 in the ground engaging length having a bottom 16 (in phantom lines) in which bottom 16 is below the feet of the user so that bottom 16 contacts the surrounding ground upon which the user stands. Convertible garment 10 is also convertible to a coverall as depicted in FIG. 2.

Figure 3:
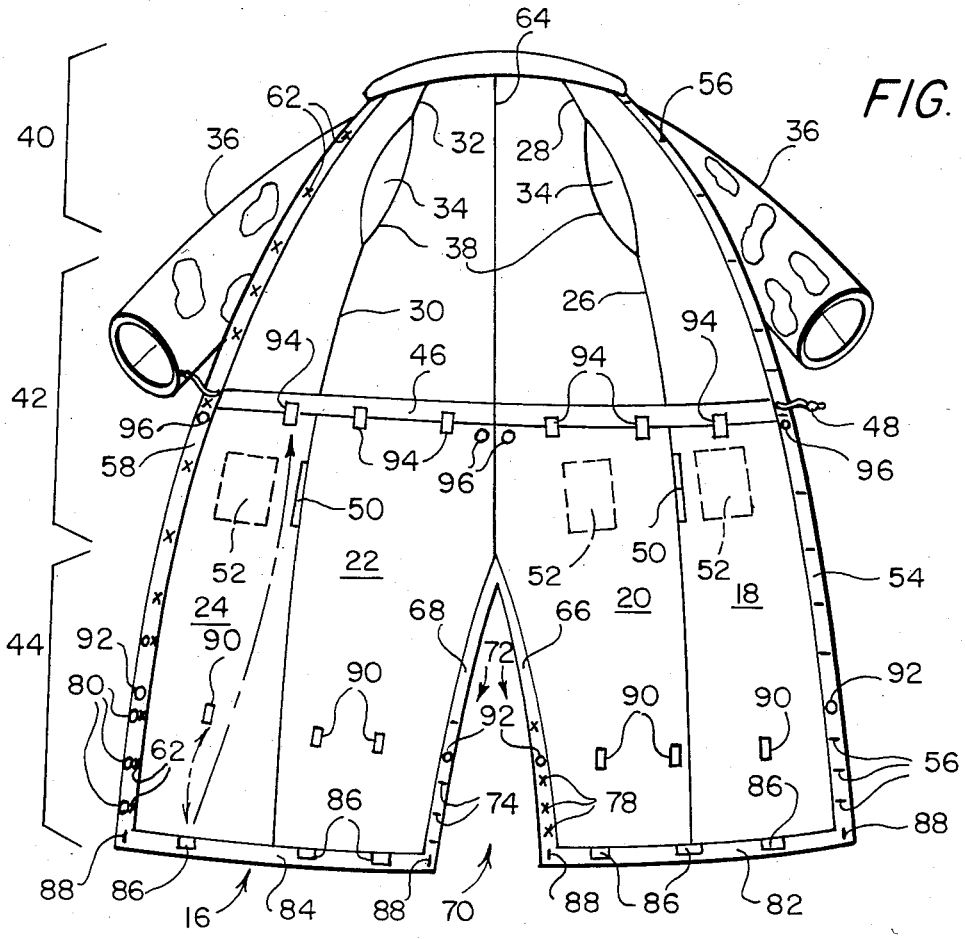
FIG. 3 is a front elevation view of the inside of the convertible garment of the present invention in the ground engaging length form.

As shown best in FIG. 3, convertible garment 10 is constructed of a left front panel 18, a left back panel 20, a right back panel 22, and a right front panel 24. These panels are preferably formed of a waterproof cloth material suitably provided with camouflage markings as shown. Left front panel 18 and left back panel 20 are joined together by a longitudinal left side seam 26 and along a top left seam 28 to form a left shoulder portion. Similarly, right back panel 22 and right front panel 24 are sewn together along a longitudinal right side seam 30 and top right seam 32. An opening 34 is provided between longitudinal left side seam 26 and top left seam 28 as well as between longitudinal right seam 30 and top right seam 32. Openings 34 accommodate the arms of the user and sleeves 36 are attached at these openings as shown by sleeve seams 38.

For convenience, panels 18, 20, 22, and 24 are considered to have upper portions 40, middle portions 42, and lower portions 44. Located across the inside of panels 18, 20, 22, and 24 at about the location of the waist of the user in middle portions 42 is a reinforcing strip 46. Reinforcing strip 46 includes end openings through which a cord 48 extends. Cord 48 is used to gather middle portions 42 about the waist of the user as desired. Located below reinforcing strip 46 along longitudinal left side seam 26 and longitudinal right side seam 30 are openings 50. Openings 50 allow the user to reach inside of convertible garment 10 to pants pockets or the like in another garment while convertible garment 10 is being worn over such a garment. Located on the outside of convertible garment 10 at middle portions 42 of panels 18, 20 and 24 are pockets 52 for convertible garment 10.

Located along the length of left front panel 18 is a longitudinal pleat 54. Longitudinal pleat 54 is provided with a plurality of button holes 56 along the length thereof. Right front panel 54 includes a longitudinal pleat 58 along which a plurality of buttons 60 are provided on the outside and which are attached to longitudinal pleat 58 by schematically depicted button fastenings 62 on the inside. Obviously, there is a mating button 60 for each button hole 56 in convertible garment 10.

Left back panel 20 and right back panel 22 are connected together by a longitudinal back seam 64 extending along upper portions 40 and middle portions 42. Below longitudinal back seam 64, left back panel 20 includes a pleat 66 and right back panel 20 includes a pleat 68. Pleats 66 and 68 form a rear vent 70. Rear vent 70 is optionally closable by the provision of a back attaching means 72. Conveniently, back attaching means 72 includes a plurality of button holes 74 located along pleat 68 and a corresponding plurality of buttons 76 located along the outside of pleat 66 with corresponding button fastenings 78 on the inside of pleat 66 as shown. It should be appreciated that the spacings of button fastenings 78 along pleat 66 corresponds to the spacings of button holes 56 along the lower portion 44 of longitudinal pleat 54. Similarly, the spacings of button holes 74 of pleat 68 correspond to the spacings of buttons 80 provided along the inside of longitudinal pleat 58 adjacent button fastenings 62 as shown.

Located at the bottoms of left front panel 18 and left back panel 20 is a pleat 82. Similarly, a pleat 84 is located along the bottoms of right back panel 22 and right front panel 24. As shown, Velcro hooked tabs 86 are spaced along pleat 82 and 84. In addition, at each end of pleats 82 and 84 are button holes 88. Spaced approximately midway along lower portions 44 of panels 18, 20, 22 and 24 are a plurality of Velcro fiber tabs 90 and buttons 92. It should be appreciated that the spacings of buttons 92 and Velcro fiber tabs 90 correspond to the spacings of button holes 88 and Velcro hook tabs 86 along pleats 82 and 84. Similarly, located along the middle of middle portions 42 of panels 18, 20, 22, and 24 is another set of velcro fiber tabs 94 and buttons 96. Velcro fiber tabs 94 and buttons 96 are also spaced similar to the spacings of Velcro hook tabs 86 and button holes 88.

Figure 4:
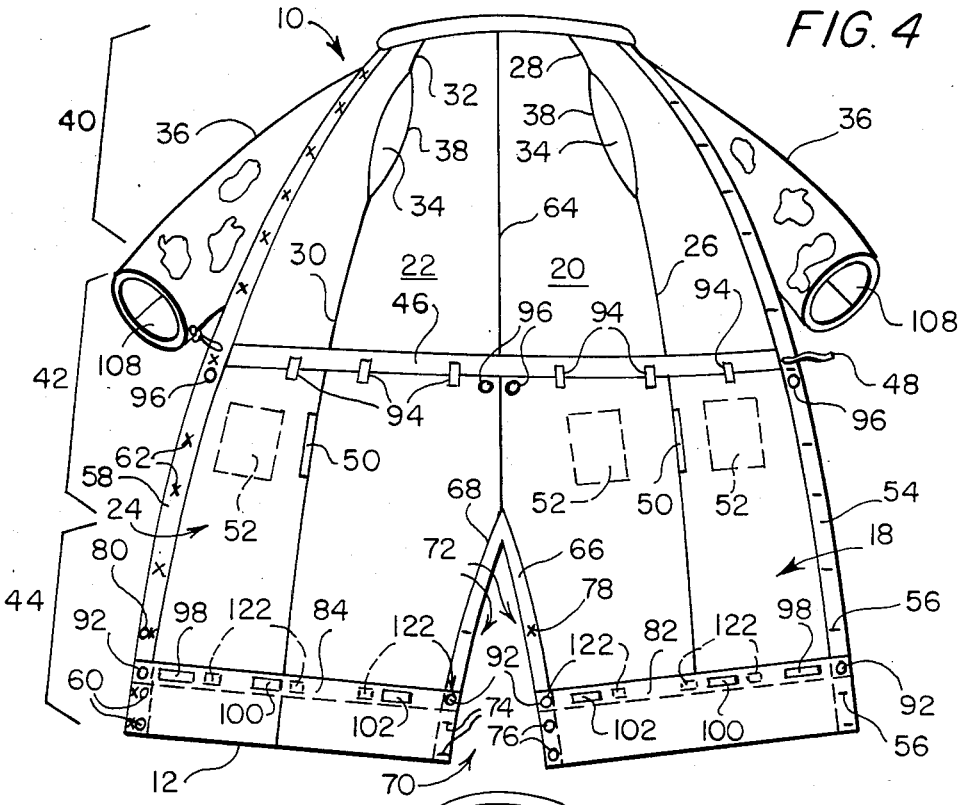
FIG. 4 is a front elevation view of the inside of the convertible garment of the present invention in the raincoat length form.
Figure 5:
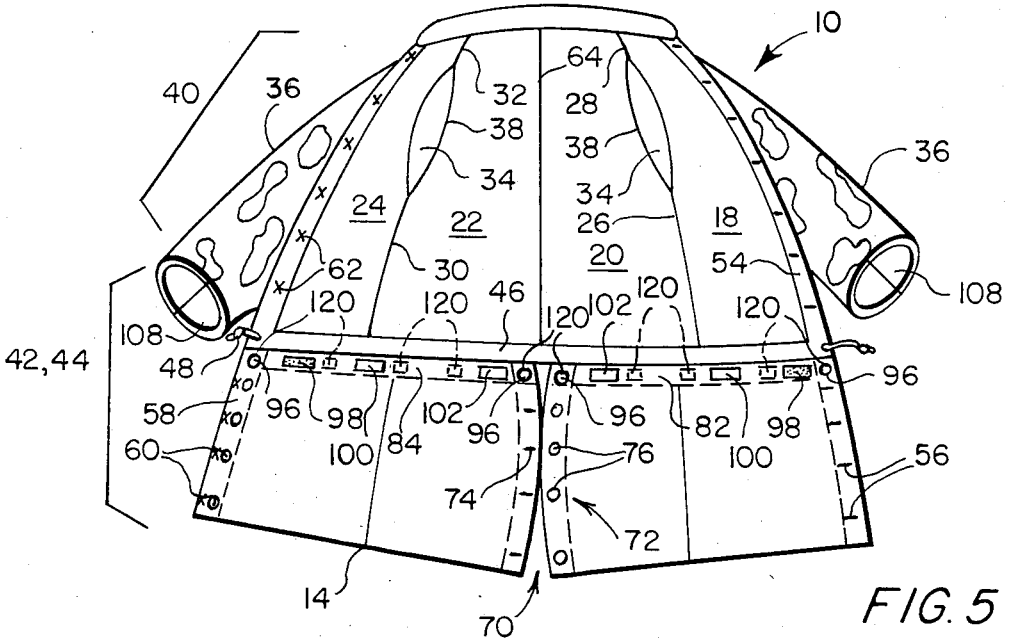
FIG. 5 is a front elevation view of the inside of the convertible garment of the present invention in the car coat length form.

As shown best in FIGS. 4 and 5, the outer sides of pleats 82 and 84 each include a Velcro hook tab 98. In addition, Velcro fiber tabs 100 and 102 are located along pleats 82 and 84 and are releasably attached to an underlying Velcro hook tab (not shown). Velcro fiber tabs 100 and 102 are each connected to the associated pleat 82 and 84 by an elastic band 104 which also extends inside of respective pleats 82 and 84. Velcro hook tabs 98, Velcro fiber tabs 100 and 102, and elastic bands 104 form a gathering means for gathering the pants leg of the convertible garment 10 as depicted in FIG. 2 in the manner discussed subsequently.

Figure 6:
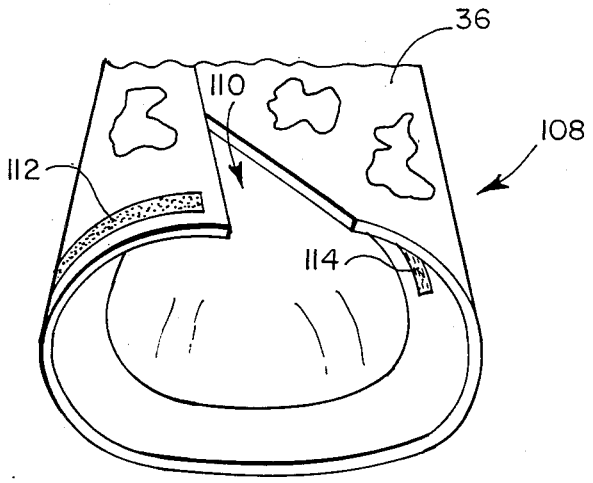
FIG. 6 is a perspective view of a cuff of the convertible garment of the present invention.

As shown in FIG. 6, each sleeve 36 of convertible garment 10 includes a cuff 108 with a vent 110. The diameter of cuff 108 is adjustable by means of a Velcro hook tab 112 provided on the outside of cuff 108 adjacent vent 110 and a Velcro fiber tab 114 located on the inside of cuff 108 adjacent vent 110. Thus, by overlapping portions of Velcro hook tab 112 and Velcro fiber tab 114, the diameter of cuff 108 is adjusted.

In use, convertible garment 10 is convertible in the following ways. Initially, assuming convertible garment 10 is in the form depicted in FIG. 3, the user simply puts on convertible garment 10 by passing his arms through sleeves 36. Next, the user attaches buttons 60 along longitudinal right pleat 58 to button holes 56 on longitudinal left pleat 54. This forms a ground engaging length garment having a bottom 16 as depicted in FIG. 1. When convertible garment 10 is used for hunting, buttons 60 are buttoned all the way to the ground so that no opening is left in the front of convertible garment 10 and the feet of the user are hidden from view. Thus, the hunter can move along the ground with his feet movements hidden from view. During movement, it is advantageous to leave vent 70 open. However, when standing in place, rear vent 70 is preferably closed using back attaching means 72 by passing buttons 76 through button holes 74. In this position, the hunter can move his feet inside of convertible garment 10 to keep them warm, without having any movement of the feet visible.

Starting again where convertible garment 10 is in the form depicted in FIG. 3, it is also possible to form convertible garment 10 into a car coat length garment having a bottom 14 as depicted in FIG. 1. This is accomplished by lifting pleats 82 and 84 upwardly to a position where Velcro hook tabs 86 engage respective Velcro fiber tabs 94. Once Velcro tabs 86 and 94 are connected, buttons 96 are inserted through respective button holes 88 to securely hold pleats 82 and 84 in position adjacent reinforcing strip 46. This form of convertible garment 10 is depicted in FIG. 5. It should be appreciated that Velcro hook tabs 86, Velcro fiber tabs 94, button holes 88, and buttons 96 form a holding means 120 for holding the lower portions of left front panel 18, left back panel 20, right back panel 22, and right front panel 24 against a respective middle portion 42. The coat shape is then completed by passing buttons 60 through respective button holes 56 down to the extent desired, typically leaving a small vent in the front and vent 70 in the rear.

Once convertible garment 10 is in the form of a car coat length garment as depicted in FIG. 5, it is a simple matter to form garment 10 into a raincoat length garment as depicted in FIG. 4. This is simply done by withdrawing buttons 96 from button holes 88 and then disconnecting Velcro fiber tabs 94 from Velcro hook tabs 86. The length of garment 10 is then extended downwards to have a bottom 12 by attaching Velcro hook tabs 86 to corresponding Velcro fiber tabs 90. In this position, buttons 92 are passed through respective button holes 88. In the raincoat length form, rear vent 70 is left open and buttons 60 are passed through respective button holes 56 down to a desired position such as depicted in FIG. 1. It should be appreciated that Velcro hook tabs 86 and Velcro fiber tabs 90 together with button holes 88 and buttons 92 form a first extension means 122 for extending bottom 14 to the position depicted by bottom 12 in FIG. 1 (or for changing garment 10 from the configuration depicted in FIG. 5 to the configuration depicted in FIG. 4).

From the raincoat length garment depicted in FIG. 4, it is apparent that bottom 12 can be extended to bottom 16 to form the ground engaging coat garment depicted in FIG. 1 fairly easily. This is accomplished by withdrawing buttons 92 through button holes 88 and by detaching Velcro fiber tabs 90 from Velcro hook tabs 86. Pleats 82 and 84 are then allowed to fall downwardly and thus extend the length of garment 10 to bottom 16. It should be appreciated that the detaching of Velcro hook tabs 86 from any associated Velcro fiber tab and the absence of any buttons in button holes 88 form a second extension means for convertible garment 10.

Convertible garment 10 is also convertible into a coverall such as depicted in FIG. 2. When using this coverall, convertible garment 10 is usually fitted over the clothes of the user to protect the clothes of the user. For example, a user not ordinarily dressed for hunting can easily put on convertible garment 10 in the coverall form and proceed to hunt without fear of soiling his regular clothes. Convertible garment 10 is converted to the coverall depicted in FIG. 2 by initially starting with convertible garment 10 in the form depicted in FIG. 3. Conveniently, the user puts his arms through sleeves 36 in order to support garment 10 on his shoulders. Thereafter, left pants leg 130 is simply formed by passing buttons 76 along pleat 66 through corresponding button holes 56 along pleat 54. It should be appreciated that pleat 54 overlaps pleat 56 in the rearward direction so that small branches and the like pass by pleat 56 as the user walks through the woods and thus do not snag in the overlapping area between pleat 54 and pleat 56 during forward movement.

Right pants leg 132 is simply formed by passing buttons 80 located along pleat 58 through corresponding button holes 74 in pleat 68. It should be appreciated that buttons 80 are specifically provided for forming right pants leg 132 in spite of the fact that right pants leg 132 would logically be formed using buttons 60 located along the outside of pleat 58. However, if buttons 60 were used, pleat 68 would overlap pleat 58 in the forward direction. This would create a forward directed opening between button holes 74 which would allow small branches and the like to pass through the spaces between button holes 74 as the user moves forward to impede the user's progress and to scratch his right leg. However, by use of buttons 80, pleat 58 abuts pleat 68 so that no forward openings are presented and the user can easily move through small brush.

In order to gather the excess length of pants legs 130 and 132 around the ankle of the user, gathering means 106 is used. This is simply accomplished by pulling Velcro fiber tabs 100 and 102 away from the underlying Velcro hook tabs and by pulling Velcro fiber tabs 100 and 102 connected to elastic bands 104 to corresponding Velcro hook tab 98. This causes elastic bands 104 to be stretched and thus to gather the material of pleats and 84 around the respective ankles of the user.

To complete forming of the coverall depicted in FIG. 2, the user simply buttons the remaining buttons 60 through corresponding button holes 56 as shown in FIG. 2. If desired, the user can also adjust the tightness of cuff 108 around each wrist by appropriate placement of Velcro hook tab 112 relative to Velcro fiber tab 114. In addition, cord 48 is preferably pulled tight at the waist and tied as shown.

While the present invention has been described with respect to an exemplary embodiment thereof, it will be understood by those of ordinary skill in the art that variations and modifications can be effected with the scope and spirit of the invention.

I claim:

1. A convertible garment for a user comprising:

a left front panel and a left back panel, said left front panel and said left back panel being joined along a common longitudinal left side seam and along a top left seam to form a left shoulder portion, each of said left front panel and said left back panel including an upper portion, a middle portion, and a lower portion;

a left sleeve attached to said left front panel and said left back panel between said longitudinal left side seam and said top left seam.

a right front panel and a right back panel, said right front panel and said right back panel being joined along a common longitudinal right side seam and along a top right seam to form a right shoulder portion, each of said right front panel and said right back panel including an upper portion, a middle portion, and a lower portion;

a right sleeve attached to said right front panel and said right back panel between said longitudinal right side seam and said top right seam;

a back seam which connects the upper portions and middle portions of said left back panel and said right back panel, said back seam extending downwardly to the buttocks region of the user;

a holding means for releasably holding the lower portions of said left back panel, left front panel, right back panel and right front panel against a respective middle portion to form a car coat length garment;

a first front attaching means for attaching adjacent upper and middle portions of said right front panel and left front panel together whereby the car coat garment is closed as said first holding means holds respective lower portions against respective middle portions;

a first extension means for extending the lower portions of said left back panel, left front panel, right back panel and right front panel downwardly to a position to form a raincoat length garment and for releasably holding the extended lower portions of said left back portion, left front portion, right back portion and right front portion against a respective portion of said respective panels;

a second front attaching means for attaching adjacent extended lower portions of said left front portion and said right front portion together whereby the raincoat garment is closed as said second holding means holds respective extended lower portions against respective said panels;

a second extension means for extending a remaining lower portion of said left back portion, left front portion, right back portion and right front portion downwardly to a position to form a ground engaging length garment; and a third front attaching means for attaching adjacent remaining lower portions of said left front portion and said right front portion together whereby the ground engaging coat garment is closed as said remaining lower portions of said left back portion, left front portion, right back portion, and right front portion are extended.

2. A convertible garment as claimed in claim 1 and further including a back attaching means for releasably attaching the lower portions of said left back portion and right back portion together when the ground engaging garment is formed.

3. A convertible garment as claimed in claim 2 and further including a pants forming means for forming said lower portions of said left front portion and left back portion into a left pants leg and for forming said lower portions of said right front portion and right back portion into a right pants leg to form a coverall garment.

4. A convertible garment as claimed in claim 3 and further including a gathering means for gathering a bottom of each pants leg tight around a respective ankle of the user.

5. A convertible garment as claimed in claim 3 wherein said second front attaching means and said third front attaching means include a plurality of elements and mating holders with one of said plurality of elements and holders located along an outside edge of said left front portion and the other of said plurality of elements and holders located along an outside edge of said right front portion, wherein said back attaching means includes the one of said plurality of elements and holders located along an outside edge of said right back portion and the other of said plurality of elements and holders located along an outside edge of said left back portion, and wherein said pants forming means includes said plurality of elements and holders on said right back panel, said left back panel, and the one of said plurality of elements and holders located along an inside edge of said right front panel.

6. A convertible garment as claimed in claim 5 wherein the one of said plurality of elements and holders is a plurality of buttons and the other of said plurality of elements and holders is a plurality of button holes.

7. A convertible garment as claimed in claim 6 wherein said holding means includes a plurality of elements and mating holders.

* * * * *